US009057368B2

(12) United States Patent
Momeni

(10) Patent No.: US 9,057,368 B2
(45) Date of Patent: Jun. 16, 2015

(54) ROTARY CAM ACTUATED LINEAR PERISTALTIC PUMP

(71) Applicant: Ahmad Momeni, Tustin, CA (US)

(72) Inventor: Ahmad Momeni, Tustin, CA (US)

( * ) Notice: Subject to any disclaimer, the term of this patent is extended or adjusted under 35 U.S.C. 154(b) by 0 days.

(21) Appl. No.: 14/180,180

(22) Filed: Feb. 13, 2014

(65) Prior Publication Data

US 2014/0161635 A1 Jun. 12, 2014

Related U.S. Application Data

(63) Continuation of application No. 13/083,738, filed on Apr. 11, 2011, now abandoned.

(51) Int. Cl.
*F04B 43/08* (2006.01)
*F04B 43/12* (2006.01)

(52) U.S. Cl.
CPC ..... *F04B 43/082* (2013.01); *F04B 43/12* (2013.01)

(58) Field of Classification Search
CPC ..... F04B 43/082; F04B 43/12
USPC ..... 417/474, 478–749
See application file for complete search history.

(56) References Cited

U.S. PATENT DOCUMENTS

| | | | |
|---|---|---|---|
| 762,260 | A | 6/1904 | Eastwood |
| 2,861,652 | A | 11/1958 | Small |
| 2,877,714 | A | 3/1959 | Sorg et al. |
| 3,011,684 | A | 12/1961 | Corneil |
| 3,172,367 | A | 3/1965 | Kling |
| 4,025,241 | A | 5/1977 | Clemens |
| 4,199,307 | A | 4/1980 | Jassawalla |
| 4,648,812 | A | 3/1987 | Kobayashi et al. |
| 4,671,792 | A | 6/1987 | Borsanyi |
| 4,728,265 | A | 3/1988 | Cannon |
| 4,869,646 | A | 9/1989 | Gordon et al. |
| 4,893,991 | A | 1/1990 | Heminway et al. |
| 5,078,683 | A | 1/1992 | Sancoff et al. |
| 5,090,877 | A | 2/1992 | D'Silva |
| 5,152,680 | A | 10/1992 | Okada |
| 5,217,355 | A | 6/1993 | Hyman et al. |
| 5,322,422 | A | 6/1994 | Natwick et al. |
| 5,531,680 | A | 7/1996 | Dumas et al. |
| 5,575,631 | A | 11/1996 | Jester |
| 5,630,710 | A | 5/1997 | Tune et al. |
| 5,637,093 | A | 6/1997 | Hyman et al. |
| 5,683,233 | A | 11/1997 | Moubayed et al. |
| 5,709,534 | A | 1/1998 | O'Leary |
| 5,718,569 | A | 2/1998 | Hoist |
| 5,791,881 | A | 8/1998 | Moubayed et al. |
| 5,842,841 | A | 12/1998 | Danby et al. |
| 5,879,144 | A | 3/1999 | Johnson |

(Continued)

FOREIGN PATENT DOCUMENTS

| | | |
|---|---|---|
| DE | 3202251 | 8/1983 |
| DE | 2152352 | 5/2011 |

(Continued)

*Primary Examiner* — Christopher Bobish
(74) *Attorney, Agent, or Firm* — Stetina Brunda Garred & Brucker

(57) ABSTRACT

A rotary cam actuated linear peristaltic pump includes a plurality of cams which actuate a plurality of pistons. The cams apply a force to the piston by way of a lifter for providing mechanical advantage so that a smaller motor may be used to rotate the cam. Each piston of a plurality of pistons is sequentially raised to the extended position to squeeze a tube so as to flow fluid through the tube.

6 Claims, 10 Drawing Sheets

(56) References Cited

U.S. PATENT DOCUMENTS

| | | | | |
|---|---|---|---|---|
| 5,938,413 | A | 8/1999 | Makino et al. | |
| 6,164,921 | A | 12/2000 | Moubayed et al. | |
| 6,234,773 | B1 | 5/2001 | Hill et al. | |
| 6,270,326 | B1 * | 8/2001 | Kuriyama | 417/477.4 |
| 6,371,732 | B1 | 4/2002 | Moubayed et al. | |
| 7,217,108 | B2 | 5/2007 | Herwig et al. | |

FOREIGN PATENT DOCUMENTS

| | | |
|---|---|---|
| FR | 1529535 | 6/1968 |
| GB | 1025983 | 4/1966 |
| JP | 2125983 | 5/1990 |
| WO | WO9734084 | 9/1997 |

* cited by examiner

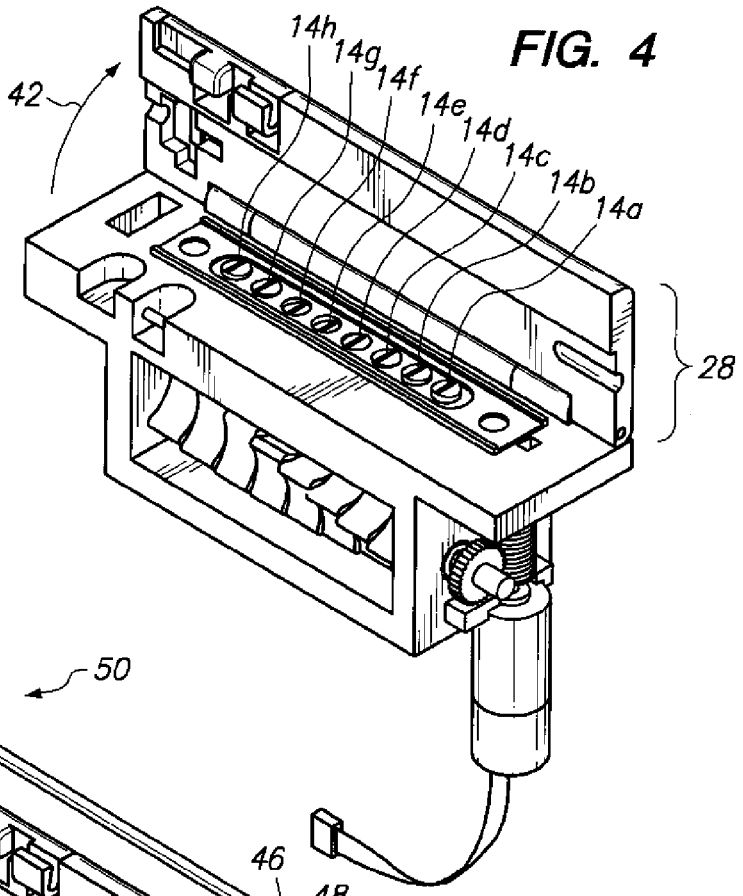
FIG. 4
FIG. 5
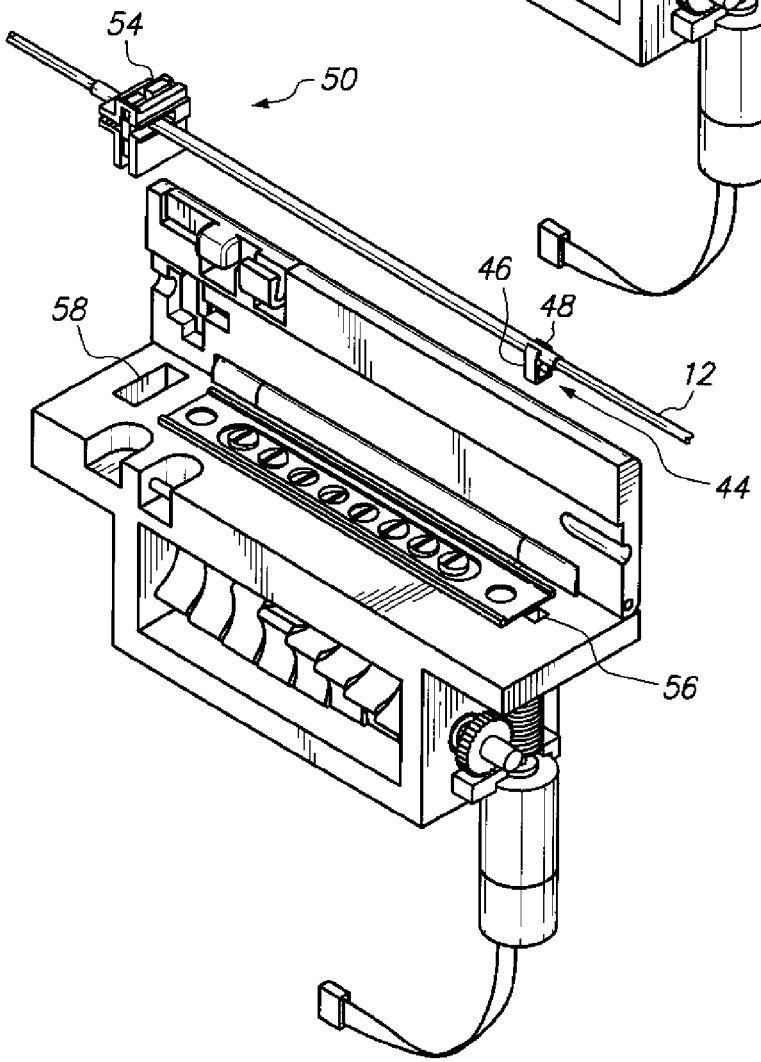

ROTARY CAM ACTUATED LINEAR PERISTALTIC PUMP

CROSS-REFERENCE TO RELATED APPLICATIONS

The present application is a continuation of U.S. patent application Ser. No. 13/083,738 entitled ROTARY CAM ACTUATED LINEAR PERISTALTIC PUMP filed Apr. 11, 2011, the entirety of the disclosures of which are expressly incorporated herein by reference.

STATEMENT RE: FEDERALLY SPONSORED RESEARCH/DEVELOPMENT

Not Applicable

BACKGROUND

The embodiments discussed herein relate to a peristaltic pump.

Peristaltic pumps are typically used in medical applications for metering intravenous infusion of a medication into a patient. Peristaltic pumps may also be used for withdrawing fluid such as in wound drainage procedures. To this end, various linear and curvilinear peristaltic pumps have been introduced into the market place.

For example, the curvilinear peristaltic pump described in U.S. Pat. No. 6,164,921 (hereinafter '921 patent) was introduced into the marketplace. The entire contents of the '921 patent is expressly incorporated herein by reference. The first named inventor of the '921 patent is the inventor of the device described below in the detailed description section. As shown in FIG. 7 of the '921 patent, a flexible tubing is inserted between a plurality of fingers and a platen. The fingers are arranged in a curved pattern. Also, the bottom surface of the platen which work in conjunction with the fingers is also curved and matched to the curvature of the plurality of fingers. As the cam rotates, the lobes of the cam push the fingers into the tube disposed between the fingers and the bottom surface of the platen in a rolling manner to urge fluid through the tube.

Unfortunately, the peristaltic pump disclosed in the '921 patent has certain limitations. To operate the pump, the tube is installed between the platen and the fingers of the pump by opening the platen, fitting a locator pin and a shut off valve into recesses formed in a body of the pump and closing the platen. In doing so, it is difficult to fit the locator pin and the shut off valve into the recesses due to the curved configuration of the fingers and the curved bottom surface of the platen. Moreover, the tube is typically installed on the pump when the pump is hung on a stand next to a patient. However, the pump is top heavy causing the pump to be unstable and shift during installation of the tube.

Another limitation of the device disclosed in the '921 patent is that the flow rate through the pump is low fluid in the range of 600 mL. The flow rate of the pump is dependent on a variety of factors such as cycle speed of the fingers, the size of the tube, etc. To increase the fluid flow rate through the pump, these factors must be improved by increasing the cyclical speed of the fingers, increasing the size of the tube, etc. Unfortunately, to do so, the size of the motor must be enlarged to handle the increased load. The pump disclosed in the '921 patent is relatively heavy. Enlarging the motor would undesirably increase the weight of the pump and may cause further instability.

Accordingly, there is a need in the art for an improved peristaltic pump.

BRIEF SUMMARY

The embodiments disclosed herein address the needs discussed above, discussed below and those that are known in the art.

A rotary cam actuated linear peristaltic pump is disclosed. The pump may have a plurality of pistons that are traversable between extended and retracted positions. The pistons are traversed toward the extended position in a sequential manner through a plurality of cams. Cam lobes of each of the cams are angularly offset with respect to the prior and subsequent cams. The cam lobes are operative to traverse the pistons toward the extended position. Since the cam lobes are offset, the pistons are traversed to the extended position in a wave format during rotation of the cams. A tube is disposed between the piston and a platen. As the pistons move to the extended position, the piston and the platen squeeze the tube so as to occlude the tube and prevent the flow of fluid through the occluded portion thereof. Initially, a first cam traverses a first piston to occlude the tube. The next cam traverses the next piston towards the extended position to also occlude the tube. However, during this period of time, the first piston prevents fluid flow through the tube. Since the second piston is applying pressure to the tube, the fluid flows to the path of least resistance, specifically, to the opposite side of the first piston. The third and subsequent pistons continue this movement until the fluid is pushed out of the pump.

The cams are mounted to a rotating cam shaft. The cam shaft is rotated with a motor. A motor and the cam shaft are in mechanical communication with each other by way of a worm drive and a worm gear. The worm drive and worm gear provide a gear reduction (i.e., mechanical advantage) so that a smaller motor is capable of running the pump. Moreover, the worm drive and worm gear prevent reverse rotation of the cam shaft during operation. This prevents fluid from back flowing through the tube. The cams also raise lifters which provide a mechanical advantage to reduce the load required to lift or traverse the pistons to the extended position. In particular, the pistons are preferably disposed about half way between a pivot point of the lifter and the cam. As such, the cam need only generate about one half the force to lift the piston to raise the piston since the lifter functions as a lever. Accordingly, a smaller motor can flow fluid through the tube at a greater rate (e.g., 1500 mL), as discussed below.

A plurality of cams are stacked upon a common rotating shaft driven by the motor. Each of the cams may have a plurality of lobes which raise the lifters and traverse the pistons to the extended position. The corresponding lobes of adjacent cams are angularly displaced so that one set of corresponding lobes of the plurality of cams provide one pump cycle. If there are four lobes on each of the cams then there are four pump cycles.

More particularly, a peristaltic pump for flowing fluid through a lumen of a tube wherein the tube may define a diameter is disclosed. The pump may comprise a plurality of pistons, a plurality of lifters, a platen, a rotatable cam shaft, and a plurality of cams. The plurality of pistons may be linearly arranged adjacent to each other in a straight configuration. Each of the plurality of pistons may define opposed first and second ends. Each of the plurality of pistons may be traversed between extended and retracted positions.

Each of the lifters is pivotable about a pivot axis.

The platen may be disposed adjacent to the first ends of the plurality of pistons. The platen may be generally parallel to the plurality of pistons. A gap between a first end of a piston and the platen may be about equal to or more than a diameter of the tube when the piston is traversed to the retracted position. The gap may be smaller than the diameter of the tube when the piston is traversed to the extended position.

The rotatable cam shaft may be generally parallel to the plurality of pistons.

The plurality of cams may be mounted to the rotatable cam shaft. Each of the cams may have a cam lobe. The cam lobes of the plurality of cams may be disposed adjacent to the second end portions of the lifters with the second ends of the pistons positioned in between the second end portions of the lifters and the pivot axis of the lifters. As the cam shaft rotates, the lobes raise the lifters which provide a mechanical advantage to traverse the pistons to the extended position. The cams are angularly displaced with respect to the adjacent cam. The pistons are sequentially traversed to the extended position to flow fluid through the tube.

The platen may be traversed between an open position for inserting or removing the tube between the plurality of pistons and the platen and a closed position for flowing fluid through the lumen of the tube when the tube is disposed between the platen and the plurality of pistons.

The pump may further comprise a worm gear attached to the cam shaft; a worm drive engaged to the worm gear; and a motor attached to the worm drive for rotating the worm drive.

The plurality of pistons may linearly occlude the tube as each one of the plurality of pistons is sequentially traversed to the extended position due to the progressive angular displacement of the cams.

Each of the cams may have four lobes spaced 90 degrees apart from each other. The total angular displacement of the plurality of cams may be about 90 degrees.

The cam lobes of the cams may have a curved peak surface defined by an arc having a center about a rotating axis of the cam shaft and the cams. The curved peak surfaces of cam lobes of adjacent cams may be offset and overlap one another to urge fluid through the tube in one direction.

The pistons may reciprocate between extended and retracted positions about a common axis. The common axis of the reciprocating pistons, a flat surface of the platen and a rotating axis of the cam shaft may be parallel with each other.

Moreover, a method of operating a peristaltic pump for flowing fluid through a lumen of a tube is disclosed. The method may comprise the steps of disposing the tube between a platen and a plurality of pistons wherein the tube is straight and parallel to the platen and the plurality of pistons; sequentially traversing the plurality of pistons to an extended position; occluding the tube linearly down the tube when the pistons are sequentially traversed to the extended position; and pushing the piston back to a retracted position due to resiliency of the tube.

The disposing step may further include the step of traversing the platen from an open position to a closed position.

The method may further comprise the step of aligning the tube to be parallel to the platen and a cam shaft. The method may also further comprise the step of rotating a cam shaft on which a plurality of cam are mounted. Each of the cams may have a cam lobe angularly offset from cam lobes of adjacent cams. The method may further comprise the step of actuating a plurality of lifters to sequentially traverse the plurality of pistons to the extended position.

BRIEF DESCRIPTION OF THE DRAWINGS

These and other features and advantages of the various embodiments disclosed herein will be better understood with respect to the following description and drawings, in which like numbers refer to like parts throughout, and in which:

FIG. 4 is a perspective view of the pump shown in FIG. 3 with a platen disposed in an open position;

FIG. 5 is a perspective view of the pump shown in FIG. 4 alongside the tube to be inserted into the pump;

DETAILED DESCRIPTION

Figure 10:
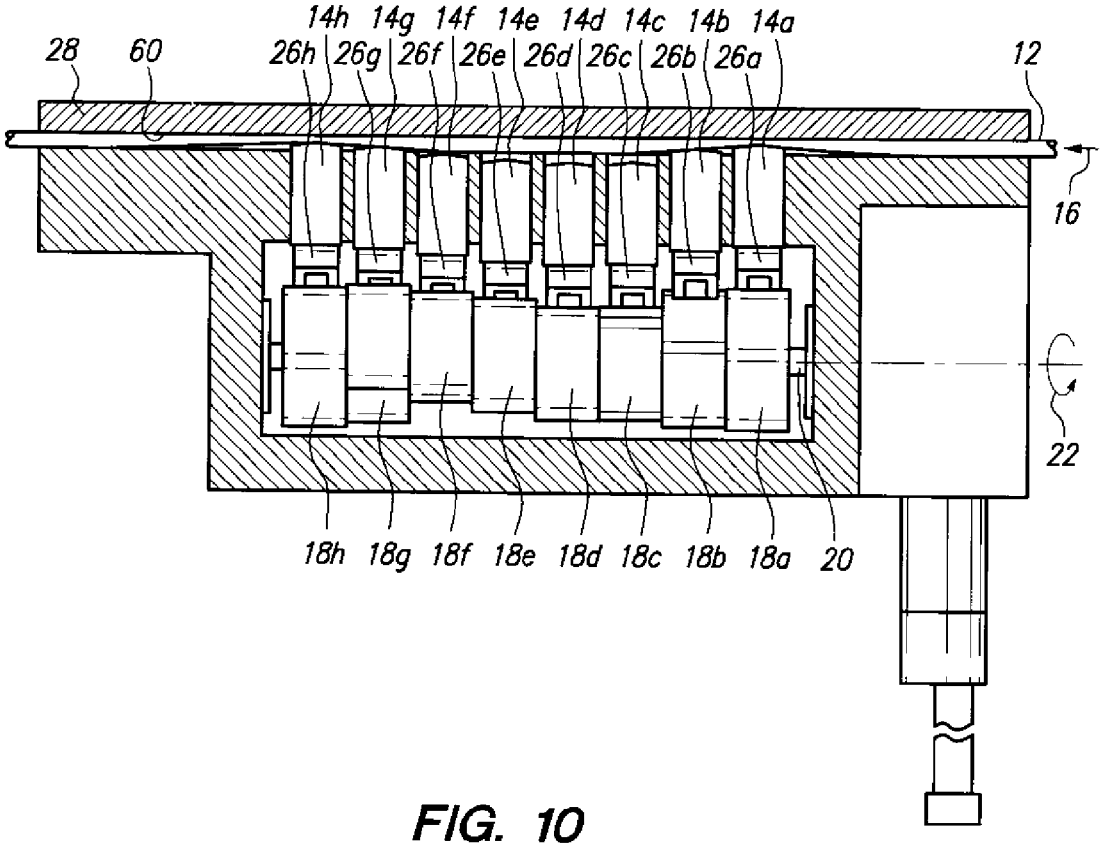
FIG. 10 is a longitudinal cross sectional view of the pump shown in FIG. 8.

Referring now to the drawings, a peristaltic pump 10 is shown. The peristaltic pump 10 is operative to receive a tube 12 that can flow fluid therethrough. As shown in FIG. 10, a plurality of pistons 14*a-h* are traversable between an extended position (see piston 14*a*) and a retracted position (see piston 14*d*). The pistons 14*a-h* are sequentially traversed to the extended position from the retracted position from the right to the left to flow fluid through the tube 12 in the direction of arrow 16. The pistons 14*a-h* sequentially squeeze the tube 12 to urge the fluid through the tube 12. The pistons 14*a-h* move in a wave format as cams 18*a-h* are rotated in the direction of arrow 22 to continuously urge the fluid through the tube 12. The plurality of cams 18*a-h, n* are mounted to a cam shaft 20 that rotates in the direction of arrow 22 shown in FIG. 10. Each of the cams 18*a-h* have multiple lobes 24*a-d* (see FIG. 11). The lobes 24*a-d* of the cams 18*a-h* lift lifters 26*a-h* which act as a lever to push the piston 14 toward the tube 12. The piston 12 and a platen 28 squeeze (see FIG. 11) the tube 12 to occlude the tube 12 in the direction of arrow 16 to push the fluid in the direction 16 through the tube 12. When the peaks of the cam lobes 24*a-d* have passed the lifter 26, the resiliency of the tube 12 pushes the piston 14 back to the retracted position and allows fluid to flow through the tube 12 behind occluded section of the tube 12. Accordingly, as the pistons 14*a-h* sequentially occlude the tube 12, fluid is urged through the tube 12 in the direction of arrow 16 and additional fluid is primed into the system to flow more fluid out of the pump 10 through the tube 12.

Figure 1:
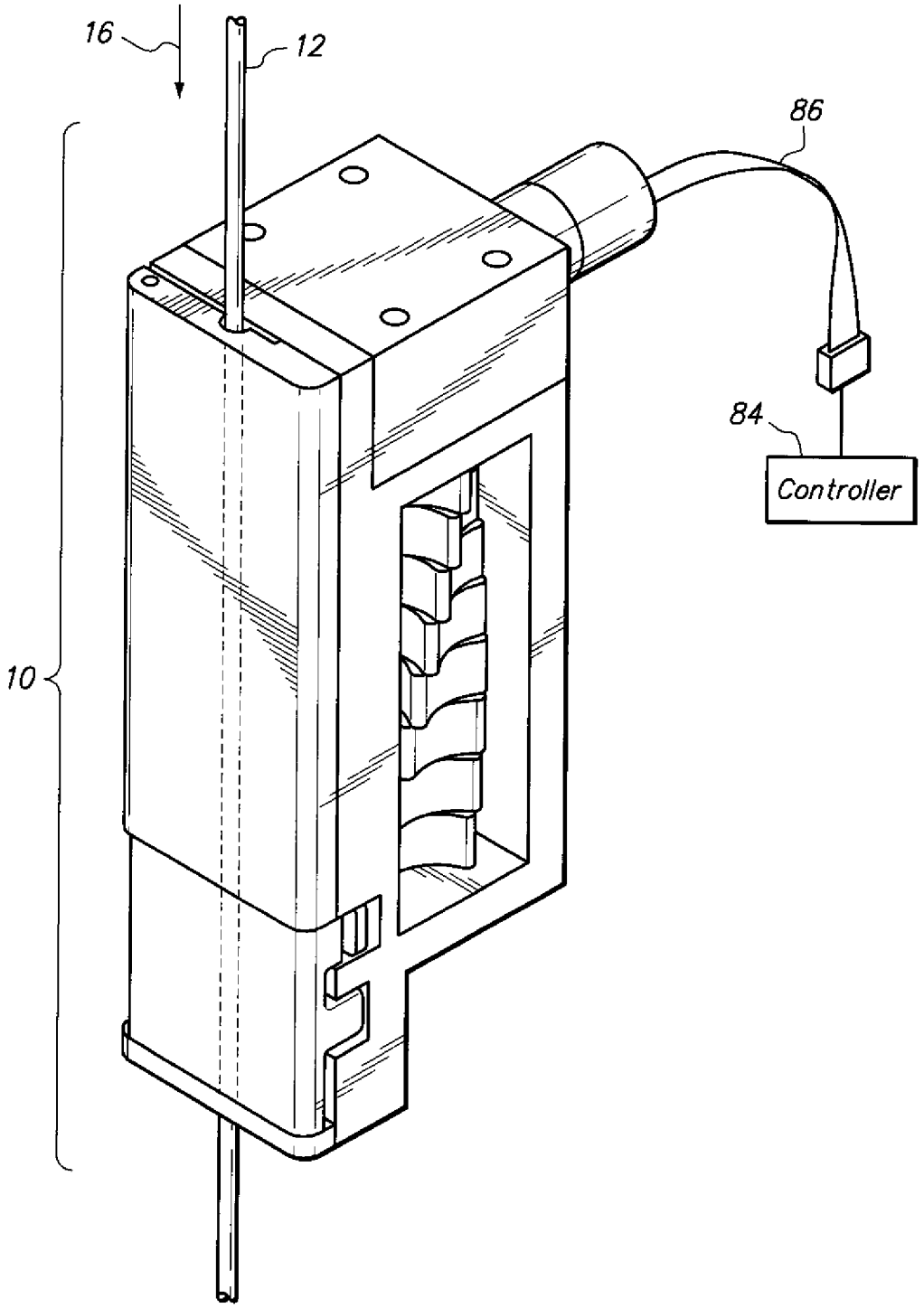
FIG. 1 is a perspective view of a rotary cam actuated linear peristaltic pump.

More particularly, the pump 10 may be hung vertically during use as shown in FIG. 1. In the vertical position, the tube 12 is easily installed into the peristaltic pump 10 and removed therefrom since the tube 12 has a straight configuration in the pump 10, as shown and discussed further below. The pump 10 may have a hook or other hanging device that allows the peristaltic pump 10 to be hung on a stand or other mechanism. The fluid flows through the tube 12 in the direction of arrow 16. However, it is also contemplated that a fluid may be made to flow in the opposite direction by reversing the direction of the cam shaft rotation. However, for the purpose of convenience, the description of the peristaltic pump 10 will be discussed in relation to fluid flowing in the direction of arrow 16.

Figure 2:
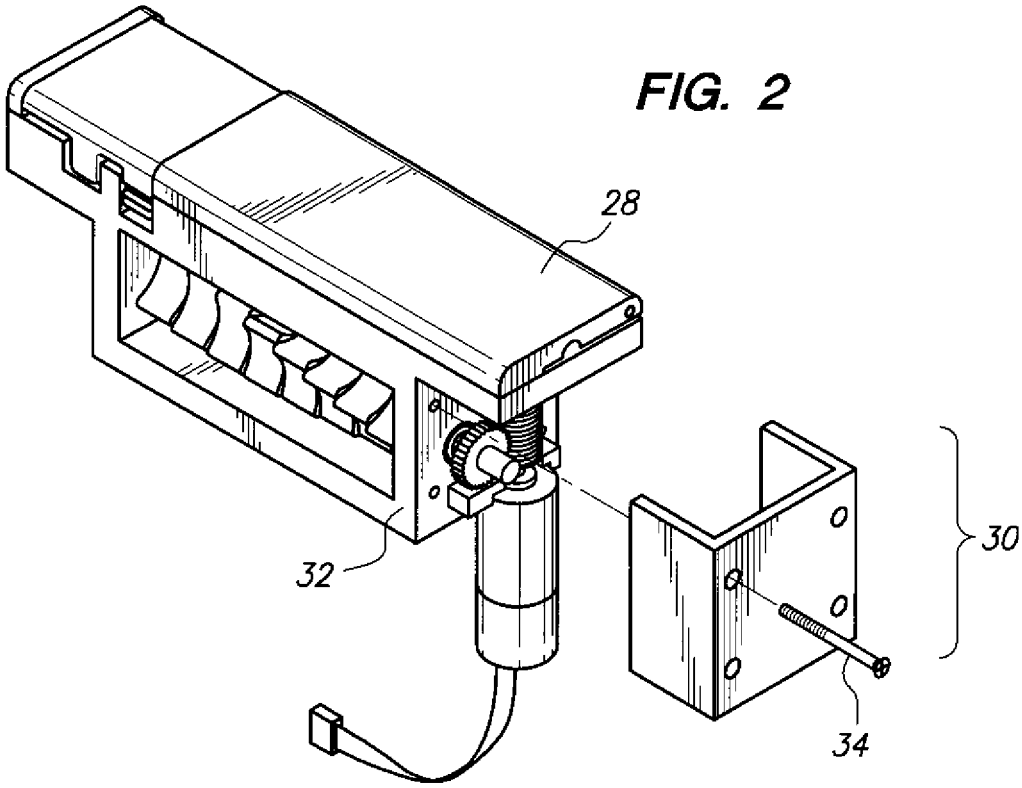
FIG. 2 is an exploded perspective view of the pump shown in FIG. 1 before a tube is installed into the pump.
Figure 3:
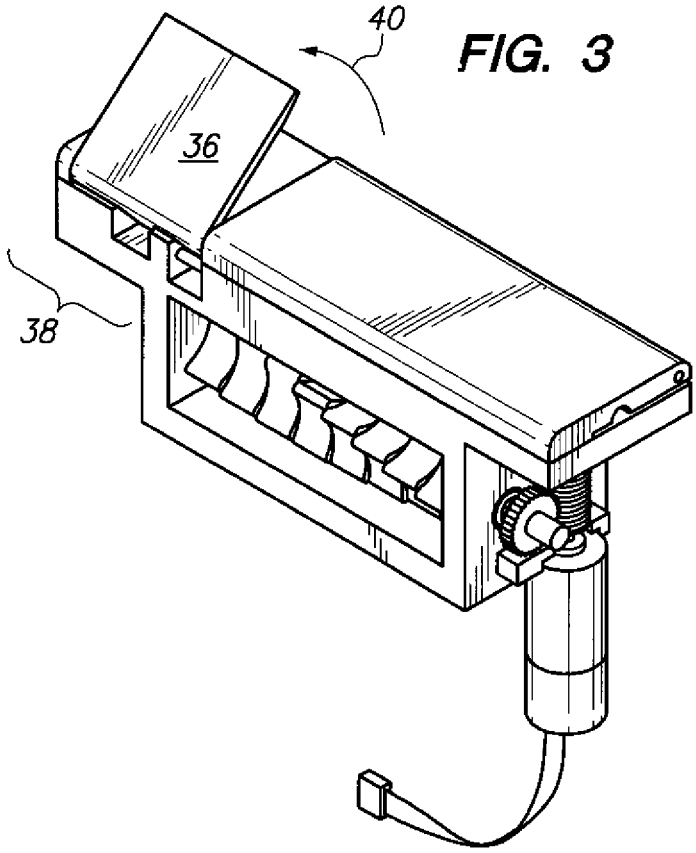
FIG. 3 is a perspective view of the pump shown in FIG. 2 with a handle of a latch being opened.

Before use, the tube 12 is not installed on the peristaltic pump 10 as shown in FIG. 2. The platen 28 is also in a closed position. In FIG. 2, a cover 30 for protecting a means for rotating the cam shaft 20 is shown as being detached from a frame 32 of the pump 10. However, during use, the cover 30 is attached to the frame 32 by way of screws 34. The cover 30 is being shown as detached from the frame 32 for the purposes of explanation.

Figure 6:
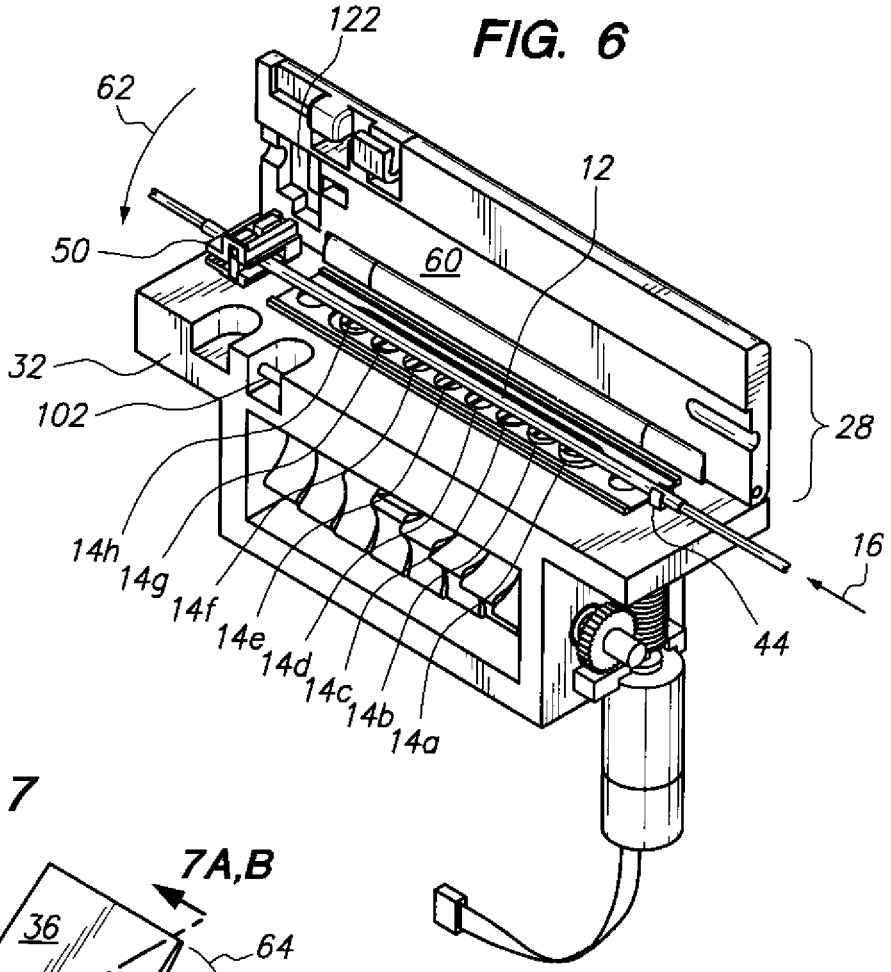
FIG. 6 is a perspective view of the pump with the tube mounted to the pump.

To install the tube 12 into the peristaltic pump 10, a handle 36 of latch 38 is moved upward in the direction of arrow 40. This releases the latch 38 and allows the platen 28 to be rotated upward in the direction of arrow 42 as shown in FIG. 4. With the platen 28 uncovering the plurality of pistons 14*a-h*, the tube 12 can be mounted to the pump 10 as shown in FIGS. 5 and 6. In particular, the tube 12 may have a positioning pin 44. The positioning pin 44 may have a post 46. The positioning pin 44 may additionally have a clip 48 that captures the tube 12. The clip 48 may be secured to the tube 12 so that the tube 12 cannot slide within the clip 48. For example, the clip 48 may be adhered to the tube 12 with adhesive, epoxy, etc. As the fluid is moved through the tube 12 by way of sequential pressure from the pistons 14*a-h*, the tube 12 does not move but remains stationary within the peristaltic pump 10 due to the positioning pin 44. On the other side of the tube 12, a pinch valve 50 is mounted to the tube 12. When the pinch valve 50 is mounted to the tube 12 as shown in FIG. 5, the pinch valve 50 occludes the tube 12 so that fluid does not flow through the tube 12 (see FIG. 7A). A wedge 52 pushes against the tube 12 to block flow through the tube 12. As will be discussed later, when the platen 28 is traversed to the closed position and the handle 36 of the latch 38 is traversed to the locked position (see FIG. 7B), a nub 120 of the handle 36 pushes against a trigger 54 of the pinch valve 50 which traverses the wedge 52 away from the tube 12 and allows fluid to flow through the tube 12.

With the positioning pin 44 and the pinch valve 50 mounted to the tube 12, the positioning pin 44 is initially inserted into a positioning pin recess 56 and the pinch valve 50 into a pinch valve recess 58 as shown in FIG. 6. In this position, the tube 12 cannot slide longitudinally or be displaced because the positioning pin 44 holds the tube 12 securely in position. Moreover, fluid does not flow through the tube 12 due to the pinch valve 50 when the platen 28 or the handle 36 is not closed. The tube 12 between the positioning pin 44 and the pinch valve 50 is laid in a straight configuration over the plurality of pistons 14*a-h*, as shown in FIG. 6. When the platen 28 is closed, the platen 28, tube 12 and the pistons 14*a-h* are generally parallel to each other, as shown in FIG. 10. During operation of the pump 10, the pistons 14*a-h* push the tube 12 against a flat surface 60 (see FIGS. 6 and 10) of the platen 28 to occlude the tube 12. The pistons 14*a-h* are sequentially raised and lowered in sequential fashion to squeeze the fluid through the tube 12 in the direction of arrow 16. The straight configuration of the tube 12 between the positioning pin 44 and the pinch valve 50 allow for easy insertion of the tube 12 into the pump 10. The tube 12 is easily insertable into the pump 10 while the pump 10 is in the horizontal position shown in FIG. 6 as well as the vertical position shown in FIG. 1.

Figure 7:
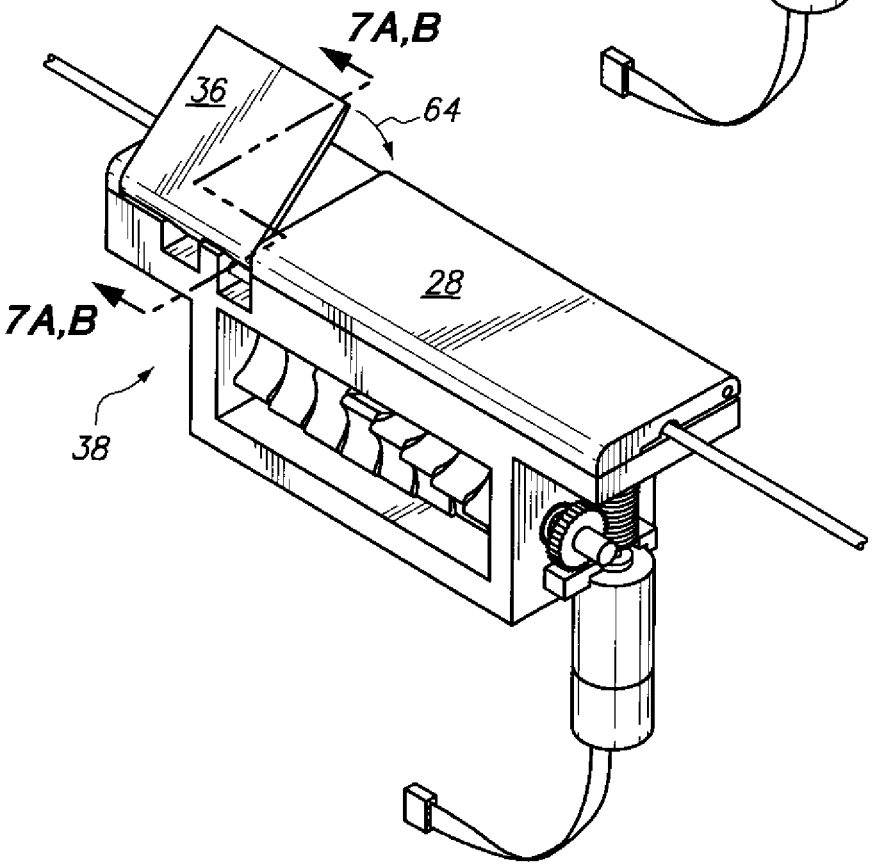
FIG. 7 is a perspective view of the pump with the platen disposed in a closed position over the tube.
Figure 8:
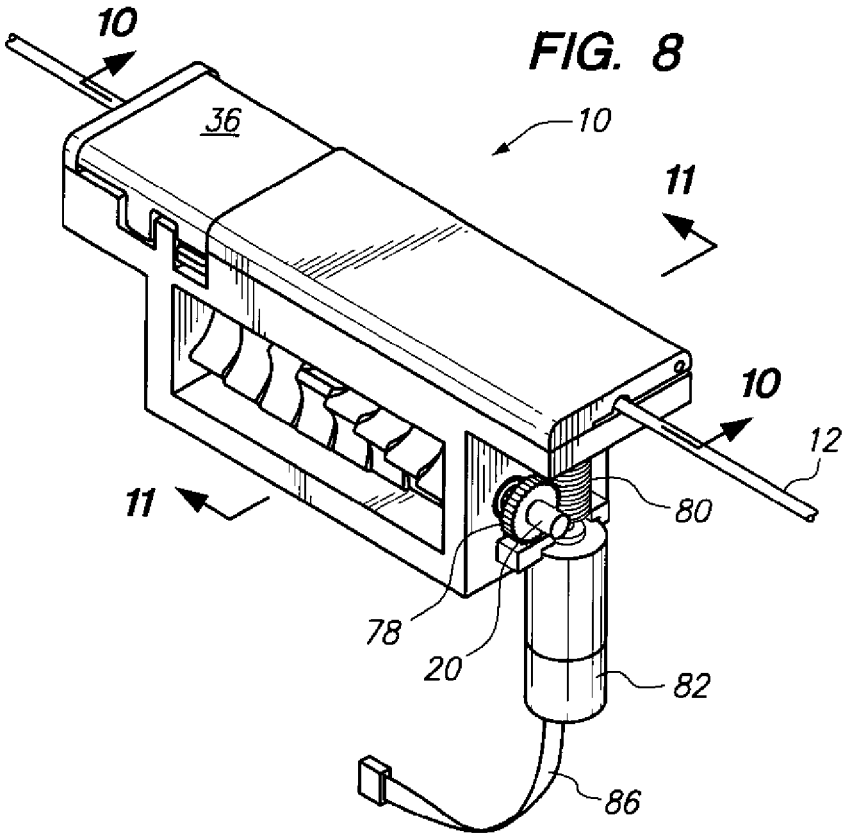
FIG. 8 is a perspective view of the pump shown in FIG. 7 with the handle in the closed position.

Referring now to FIGS. 6 and 7, the platen 28 is now traversed to the closed position (see FIG. 7) by traversing the platen 28 in the direction of arrow 62 (see FIG. 6). The handle 36 of the latch 38 is traversed to the closed position as shown in FIG. 8 by traversing the handle 36 in the direction of arrow 64 (see FIG. 7). The peristaltic pump 10 may now be hung as shown in FIG. 1 after installation of the tube 12 into the pump 10. Also, it is contemplated that the tube 12 may be installed into the peristaltic pump 10 as shown and described in relation to FIGS. 2-8 while the pump 10 is in the vertical orientation as shown in FIG. 1. The tube 12 is easily installed into the pump 10 because the tube 12 is in the straight configuration in the pump 10.

Figure 7A:
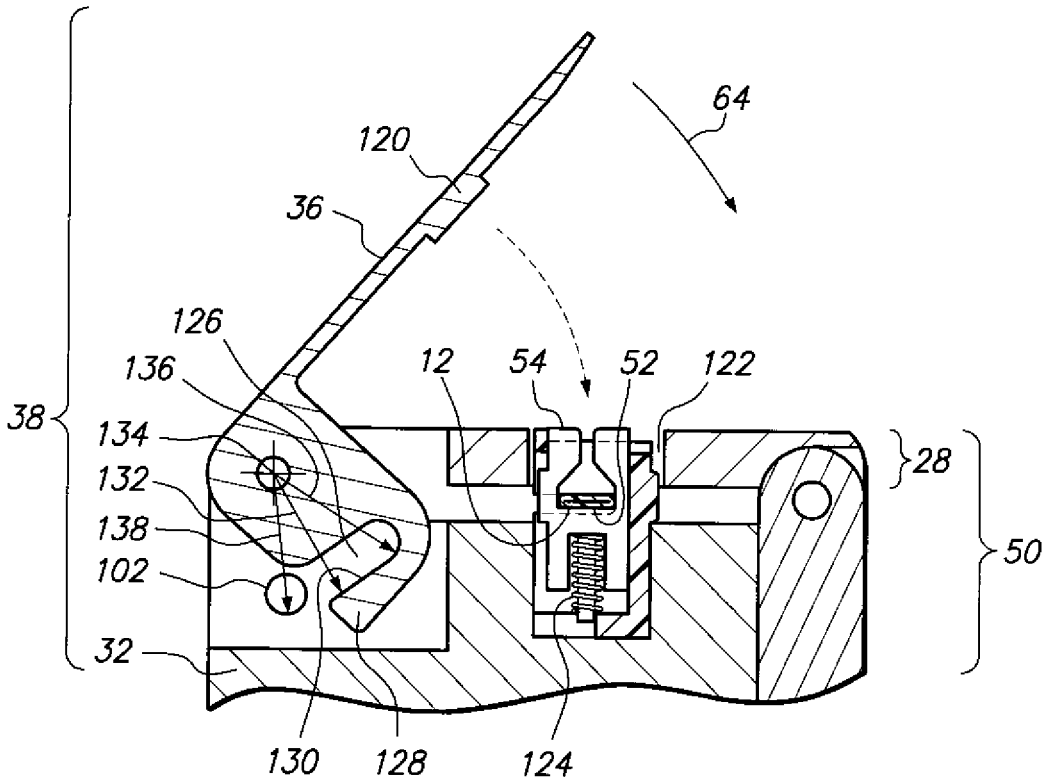
FIG. 7A is a cross sectional view of the pump shown in FIG. 7 with the handle of the latch disposed in an open position.
Figure 7B:
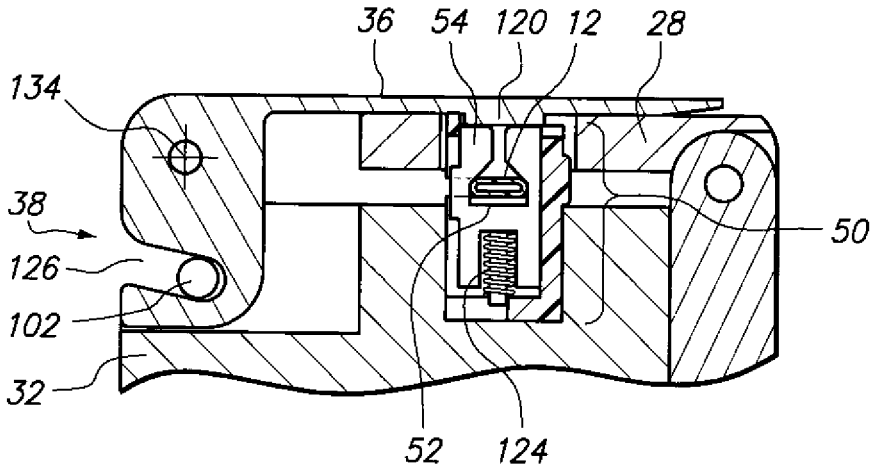
FIG. 7B is a cross sectional view of the pump shown in FIG. 7 with the handle of the latch disposed in a closed position.

Referring now more particularly, to FIGS. 7A and 7B, operation of the platen 28, latch 38 and the pinch valve 50 will be discussed. When the platen 28 is traversed downward in the direction of arrow 62 (see FIG. 6) to the closed position (see FIG. 7A), the pinch valve 50 is received into a hole 122 (see FIGS. 6 and 7A). The wedge 52 of the pinch valve 50 is normally in the extended position as shown in FIG. 7A by way of biasing spring 124. The tube 12 is squeezed by the wedge 52 so as to occlude the tube 12 and prevent the flow of fluid therethrough while setting up the pump 10 and tube 12. Before the platen 28 or the handle 36 of the latch 38 are closed, no fluid is allowed to flow through the tube 12. When the handle 36 of the latch 38 is traversed in the direction of arrow 64, nub 120 of the handle 36 contacts trigger 54 of the pinch valve 50 so that the biasing force of the spring 124 is overcome. The wedge 52 of the pinch valve 50 is urged away from the tube 12 and fluid is now allowed to flow through the tube 12 as shown in FIG. 7B.

The latch 38 is an over center latch. In particular, catch 126 receives pin 102 mounted to the frame 32 of the pump 10. The catch 126 has a pawl 128 which has an inner surface 130. A distance 132 between a pivot axis 134 of the handle 36 and a distal end of the inner surface 130 of the pawl 128 is shorter than a distance 136 between the pivot axis 134 and the proximal end of the inner surface 130 of the pawl 128. (see FIG. 7B). Distance 138 between the pivot axis 134 and the outer surface of the pin 102 is greater than distance 132. As such, when the handle 36 is initially traversed to the closed position by traversing the handle 36 in the direction of arrow 64, the pawl 128 initially hits or contacts the pin 102. Since there is a physical interference, the user must push down on the handle 36 to overcome such resistance. As the pin 102 is received into the catch 126, the pin 102 is urged further into the catch 126 since the distance of the inner surface to the pivot axis 134 is increasing. The pin 102 eventually goes over the center of the pawl 128 so that a force is required to lift the handle 36 and open the latch 38. When the pin 102 is received into the catch 126, the handle 36 cannot be moved upward or to the open position without applying an upward force to the handle 36. Moreover, the over center latch 38 provides a downward biasing force to the nub 120 so as to overcome the biasing force of the spring 124 of the pinch valve 50 when the handle is closed. Accordingly, when the handle 36 of the latch 38 is traversed to the closed position, the platen 28 is secured in the closed position and the pinch valve 50 can now allow fluid to flow through the tube 12.

Figure 9:
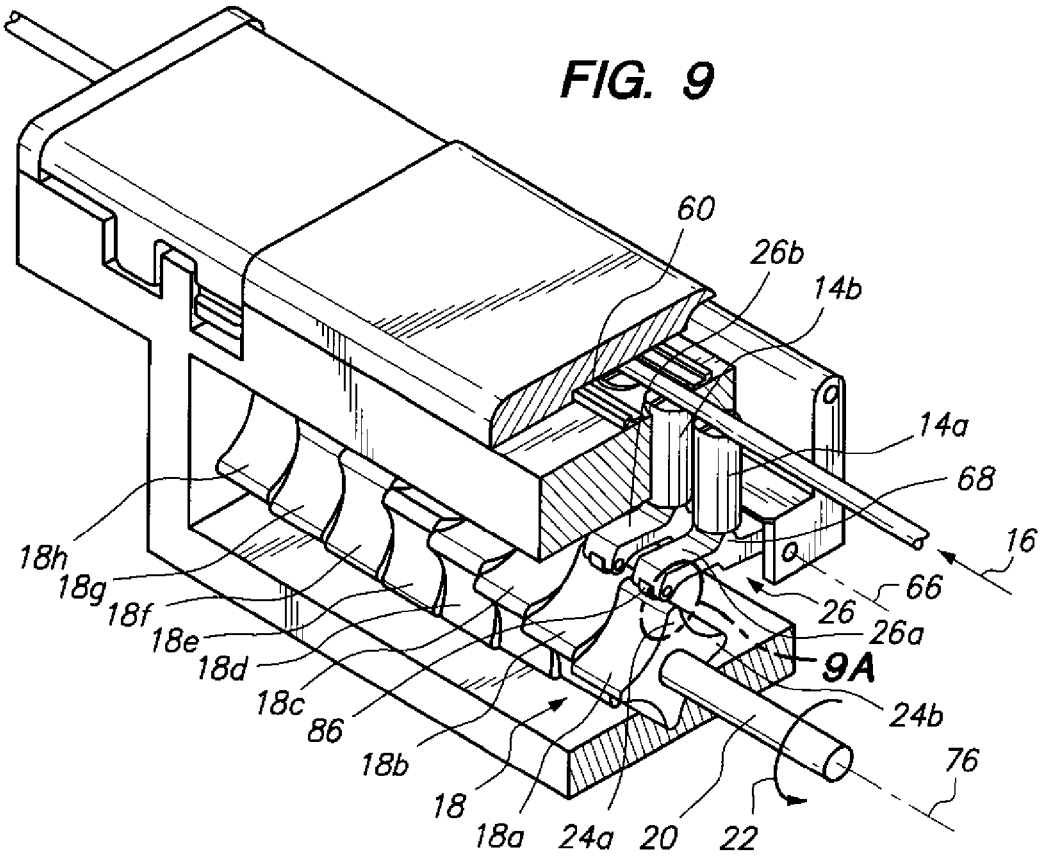
FIG. 9 is a cross sectional perspective view of the pump shown in FIG. 8.

Referring now to FIG. 9, the pistons 14*a-h* are traversed to the extended position by way of lifters 26*a-h*. The lifters 26*a-h* pivot about pivot axis 66. The lobes 24*a-d* of the cams 18*a-h* pushes rollers 86 at distal ends of the lifters 26*a-h* upward. As the rollers 86 at the distal ends of the lifters 26*a-h* moves upward, humps 68 of the lifters pushes against the pistons 14*a-h* to urge the piston 14 toward the extended position. This occurs sequentially as the cam shaft 20 rotates the cams 18*a-h*. The lifters 26 provide mechanical advantage so that a smaller motor can be used to pump more fluid through the pump. By way of example and not limitation, this arrangement can produce a flow rate of 1500 mL through the pump.

Figure 11:
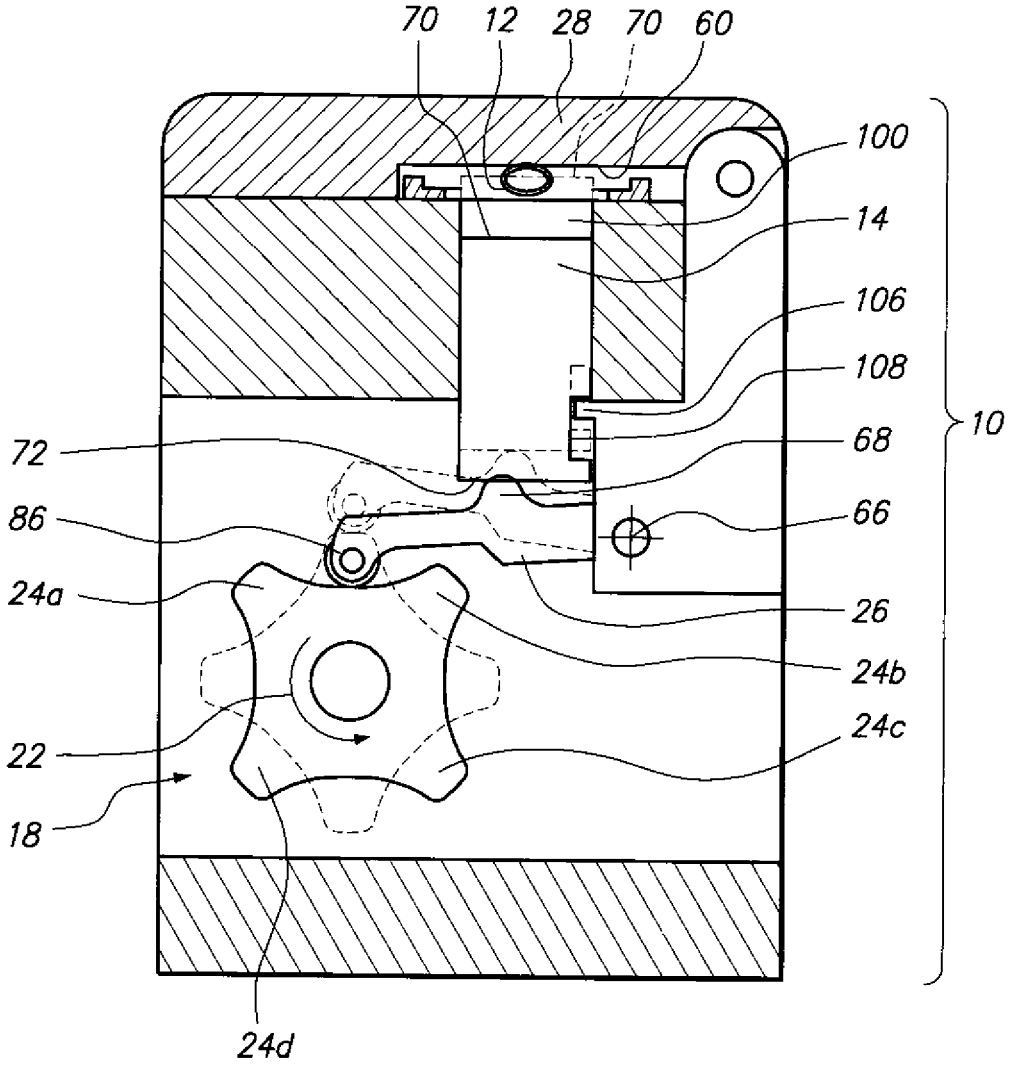
FIG. 11 is a lateral cross sectional view of the pump shown in FIG. 8.

Referring now to FIG. 11, the piston 14 defines first and second opposed ends 70, 72. The hump 68 pushes against the second end 72. As the piston 14 is traversed to the extended position, the first end 70 pushes against the tube 12 and eventually occludes the tube 12 so that fluid cannot flow through the tube 12. When the lobe 24 passes the roller 86 at the distal end of the lifter 26, the tube 12, due to its resilience, pushes the piston 14 back toward the retracted position and allows fluid to flow through the tube 12 at the position of the retracted piston 14.

Referring back to FIG. 9, the cams 18*a-h* are mounted to the cam shaft 20. Each subsequent cam 18 is angularly displaced compared to the previous cam 18. For example, the cam 18*b* is displaced angularly with respect to cam 18*a*. Cam 18*e* is displaced slightly more than 18*b*. This continuous increased angular displacement of the cam 18 is continued on through the rest of the cams 18*d-h*. As shown, the plurality of cams 18*a-h* are angularly displaced a bit further from each prior cam. This allows for the sequential movement of the pistons 14*a-h*.

Figure 9A:
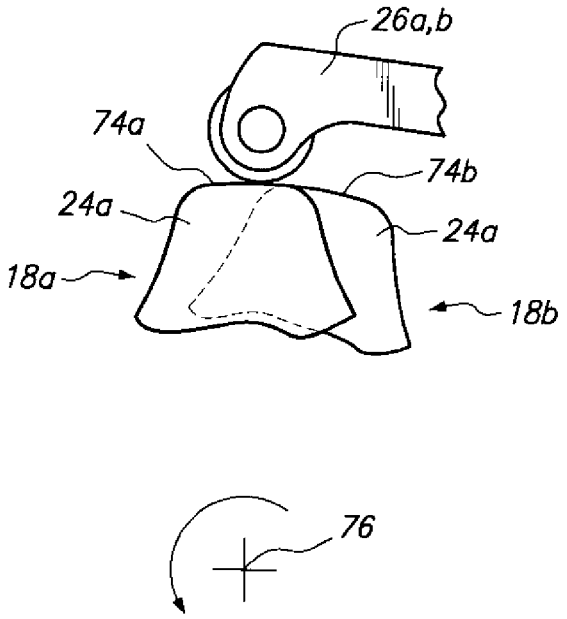
FIG. 9A is a side view of cam lobes of adjacent cams shown in FIG. 9.

The cam lobes 24*a-d* of the cams 18*a-h* each have curved peak surfaces 74*a*. Referring now to FIG. 9A, the cam lobes 24*a* of cams 18*a, b* each have curved peak surfaces 74*a* The curvature of the peak surface 74*a* is defined by an arc where its center is the central rotating axis 76 of the cam shaft 20 and the cams 18*a-h*. The curved peak surfaces 24*a* of the lobes 24*a* of adjacent cams 18*a, b* are synced or overlap one another. In particular, the curved peak surface 74*a* of cam lobe 24*a* of cam 18*a* maintains lifter 26*a* in the up position so that the piston 14*a* is at the extended position. Right before the lifter 26*a* is lowered, the cam lobe 24*a* of cam 18*b* raises the lifter 26*b* to the up position so that the piston 14*b* is also at the extended position. This position is shown in FIG. 9A. Both lifters 26*a, b* are fully up and the pistons 14*a, b* are at the extended position. During operation, the piston 14*a* is initially traversed to the extended position and occludes the tube 12 (see piston 14*a* of FIG. 10). The roller 86 at the distal end of the lifter 26*a* rides on the curved peak surface 74*a* of the cam lobe 24*a* of the cam 18*a* and maintains the piston 14*a* in the extended position for a portion of the cam's rotation. The motor must be strong enough to raise the piston 14, bend and occlude the tube 12. Since the piston is raised with the lifter, the lifter 26 allows for a smaller motor to accomplish this step. During this time, cam lobe 24*a* of cam 18*b* raises the lifter 26*b* up. The piston 14*b* applies continuous increasing pressure to the tube 12 (see piston 14*b* of FIG. 10). Since pressure is increased and the piston 14*a* occludes the tube 12 at the position of piston 14*a*, the fluid is forced toward the direction of arrow 16. When the cam lobe 24*a* of cam 18*b* traverses the piston 14*b* to the fully extended position, the tube 12 is occluded at the position of piston 14*b*. The lifter 26*a* then begins its decent downward on the back side of the cam lobe 24*a* so that additional fluid is received into the tube 12 prior to the position of piston 14*b*. This primes the tube 12 for the next cycle. Piston 14*c* is traversed to the extended position and applies pressure to the tube 12 while the piston 14*b* continues to occlude tube 12. The increasing pressure applied to the tube 12 by piston 14*c* urges the fluid in the direction of arrow 16. Once the piston 14*c* is in its fully extended position, piston 14*b* begins to retract to the retracted position and the tube 12 at the position of piston 14*b* accepts additional fluid. This process is repeated until the fluid is pushed through the tube 12 and out of the pump 10. This process is repeated for cam lobes 24*b, c, d* of cams 18*a-h*. The cam lobes 24*a-d* overlaps cam lobes 24*a-d* of adjacent cams 18*a-h*. Preferably, the cam lobes 24*a-d* of the cams 18*a-h* are angularly displaced an equal amount about the rotational angle of 90°. In the example shown herein, the cams 18 have four lobes 24*a-d* angularly displaced 90° apart from each other. Accordingly, the pistons 14*a-h* are cycled 4 times for each revolution of the cam shaft 22. Additionally, the cam lobe 24*a* of the last cam 18*h* is timed to cam lobe 24*b* of the first cam 18*a* so that the peak curved surface 74*a* of cam 18*h* overlap with the peak curved surface 74*b* of cam 18*a*. This eliminates back flow of fluid through the pump during transition from the first set of cam lobes 24*a* of the cams 18*a-h* to the second set of cam lobes 24*b* of the cams 18*a-h*.

The flow rate of fluid through the pump is based on a number of different factors. For example, the flow rate is dependent on the number of lobes on each of the cams 18*a-h*. The flow rate is also dependent upon the rotational speed of the cams 18*a-h*. The flow rate may also be dependent upon the inner diameter of the tube 12. Larger inner diameters would tend to flow more fluid through the pump than tubes with smaller inner diameters. The reason is that more fluid is displaced with larger tubes as the pistons occlude the tube. However, the motor will have to work harder to drive the cams, lifters and pistons to occlude larger tubes due to the increased sized of the tube itself and its resiliency. Fortunately, the lifters 26 provide mechanical advantage so that a small motor can still drive the cams, lifters and pistons to flow fluid through larger tubes. In particular, the pump 12 discussed herein may be sized to flow fluid at a rate of 1500 mL or at least twice as fast as the pump described in the '921 patent.

Referring now back to FIG. 8, the cam shaft 20 may be rotated by way of worm gear 78, worm drive 80 and motor 82. The motor 82 may be powered and controlled by controller 84 which is in electrical communication with the motor 82 by way of cable 86. The motor 82 turns the worm drive 80 which turns the worm gear 78. The worm gear 78 is fixed to the cam shaft 20 so that the cam shaft 20 turns as the worm gear 78 turns. When the motor 82 stops turning, the cam shaft 20 does not reverse direction because the worm gear 78 and the worm drive 80 prevent such reverse rotation. Accordingly, the fluid in the tube 12 does not flow backward or in reverse when stopping the pump 10. The motor 82, worm drive 80 and the worm gear 78 comprise the means for rotating the cam shaft 20 discussed above which is protected by the cover 30.

Referring back to FIG. 11, the lifter 26 functions as a lever. The lifter 26 pivots about pivot axis 66. The lobes 24*a-d* of the cams 18 lift up the roller 86 at the distal end of the lifter 26. The hump 68 lifts up the piston 14. The hump 68 is placed about one half the distance between the pivot axis 66 and the roller 86 of the lifter. Accordingly, if a force of X is required to lift the piston 14 and occlude the tube 12 directly under the piston 14, then a force of about X/2 is required to lift the roller 86 at the distal end of the lifter 26. The lever principle reduces the force required to lift the piston 14 by providing a mechanical advantage. This has a significant impact in sizing the motor 82. In particular, the lifter 26 allows a smaller motor to turn the cams 18*a-h* faster and generate a larger force through the piston to the tube 12 so that a larger tube 12 can be installed into the pump. Moreover, the worm drive 80 and the worm gear 78 provide additional mechanical advantage so that a smaller motor 82 can be used to drive the pump 10.

The piston 14 is traversable between a retracted position shown by solid line and an extended position shown by dash lines. In the extended position, the first end 70 is pushed toward the flat surface 60 of the platen 28. In this position, the distance between the first end 70 and the flat surface 60 is less than two times the thickness of a wall of the tube 12. The piston 14 occludes the tube 12 when the piston 14 is traversed to the extended position. When the lifter 26 is lowered, the piston 14 is now free to float within the through hole 100 which receives the piston 14. The resiliency of the tube 12 pushes the piston 14 away and allows the lumen of the tube 12 to open up and allow fluid to flow through the tube 12 once again. This process is repeated during operation of the pump 10.

Figure 12:
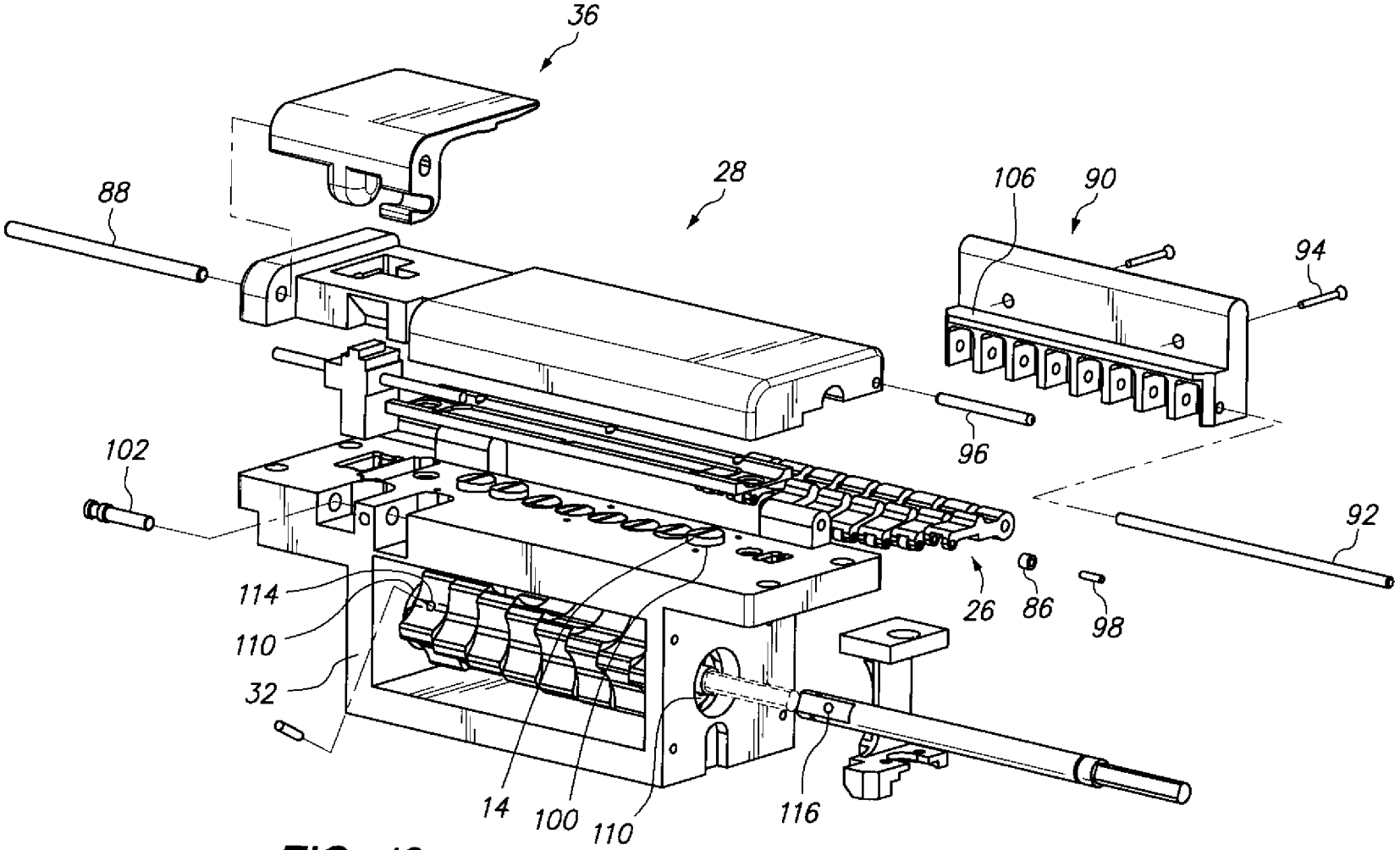
FIG. 12 is an exploded perspective view of the pump shown in FIG. 1.

Referring now to FIG. 12, an exploded perspective view of the pump 10 is shown. The handle 36 of the latch 38 is pivotally pinned to the platen 28 with pin 88. The lifters 26 are pivotally pinned to bracket 90 with pin 92. The bracket 90 is attached to the frame 32 with screws 94. The platen 28 is rotationally attached to the frame by way of pin 96. The rollers 86 are pinned to the distal ends of the lifters 26 by way of pin 98. The pistons 14*a-h* are disposed within through holes 100 formed in the frame 32. The piston 14 is held within the through holes 100 because a flange 106 of the bracket 90 is received into a groove 108 (see FIG. 13) of the piston 14, as shown in FIG. 11. The handle 36 is removably latched to pin 102 which is seated within the frame 32.

Figure 14:
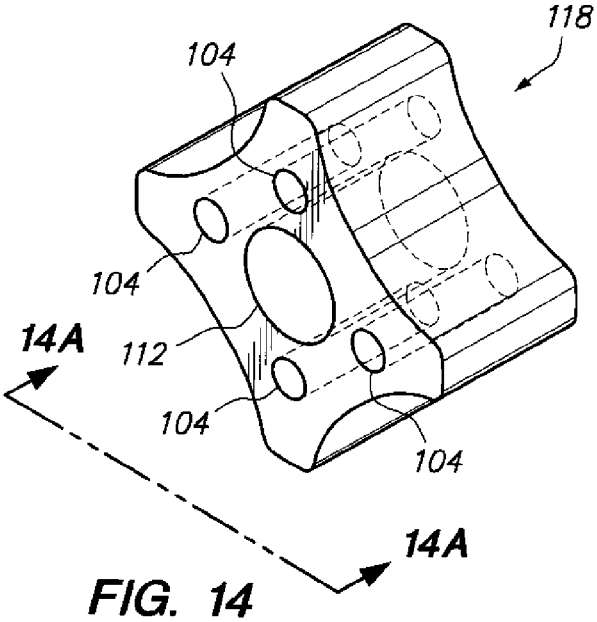
FIG. 14 is a perspective view of one cam of a stack of cams.
Figure 14A:
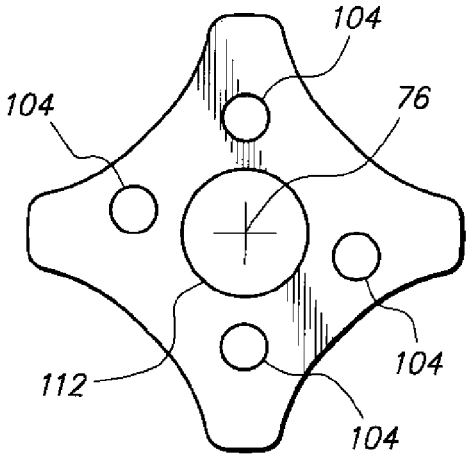
FIG. 14A is a side view of the cam shown in FIG. 14.

The process of fabricating the plurality of cams 18*a-h* may be accomplished with any known technique or any technique developed in the future. By way of example, as shown in FIG. 14, a plurality of individual cams 18 may be fabricated. Each of the cams 18 may have a plurality of through holes 104 as shown in FIG. 14A. The cams 18 may be stacked against each other and at least one through hole of adjacent cams 18 may be aligned to each other and pinned to each other. As shown in FIG. 14A, the through holes 104 are not symmetrically spread apart about the rotating axis 76 but are angularly offset from each other. In FIG. 14A, the upper and lower holes 104 are 180 degrees apart from each other angularly from the central rotating axis 76. Also, the left and right holes are 180 degrees apart from each other angularly from the central rotating axis. However, the left and right holes 104 are not 90 degrees apart from the upper and lower holes 104 angularly from the central rotating axis 76. Rather, the left and right holes 104 are skewed from the upper and lower holes 104 angularly with respect to the central rotating axis 76. In this manner, different through holes 104 of adjacent cams 18*a-h* can be aligned and pinned to each other so that the cam lobes 24 of adjacent cams 18 can have a progressive angular displacement through the stack of cams 18*a-h*. The cams 18*a-h* are stackable upon each other and may be self indexing.

After the stack of cams 18 are formed, the cams 18 are disposed within the frame 32 as shown in FIG. 12. Radial bearings 110 are mounted to the frame 32 on opposed sides thereof. The cam shaft 20 is inserted through the bearings 110 and through central holes 112 of the cams 18. The last cam 18 may have a hole 114 which is pinned to hole 116 of the cam shaft 20 to mount the shaft 20 to the cams 18.

Figure 13:
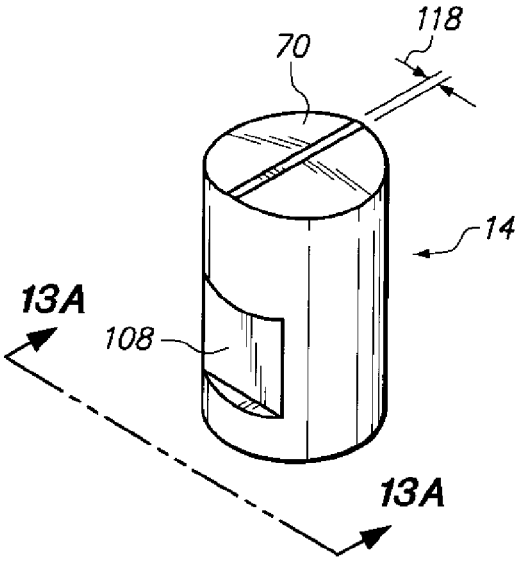
FIG. 13 is a perspective view of a piston.
Figure 13A:
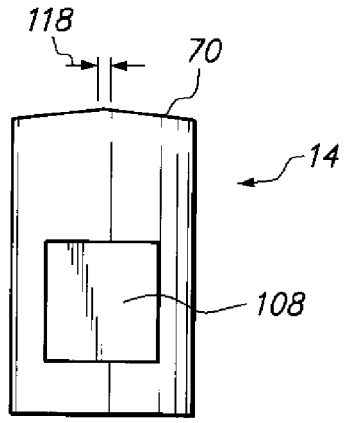
FIG. 13A is a front view of the piston shown in FIG. 13.

Referring now to FIG. 13A, a side profile of the piston 14 shown in FIG. 13 is shown. The first end 70 may have an angled surface with a flat peak surface 118. The flat peak surface 118 extends across a diameter of the piston 14 as shown in FIG. 13. The flat peak surface also is positioned traverse to the direction of fluid flow 16 and a length of the tube 12 as shown in FIGS. 5 and 6. The flat peak surface 70 is held in position because the flange 106 prevents rotation of the pistons 14*a-h*. When the piston 14 occludes the tube 12, the flat peak surface 118 pushes against the tube 12 to occlude the tube 12.

As discussed herein, the stack of cams are described as having 8 cams 18*a-h*. However, it is also contemplated that the pump 10 may have more or less than eight cams. Additionally, each of the cams 18*a-h* was described as having four cam lobes 24*a-d*. However, it is also contemplated that each of the cams 18*a-h* may have one or more cam lobes 24. The cams 18*a-h* may be formed as individual eight individual cams and stackable upon each other. The holes 104 of the cams 18*a-h* are not symmetrical and allow angular displacement of the cams 18*a-h* by aligning the holes 104 of adjacent cams 18*a-h* and pinning the holes to each other. As such, the holes 104 of the cams 18*a-h* allow the cams to be self indexing. Although the cams 18*a-h* may be formed individually and stacked upon each other, it is also contemplated that the stack of cams 18*a-h* may be formed as a unitary unit either through blow molding, machining, etc. and any method known in the art or developed in the future.

Moreover, as discussed herein, the pistons 14*a-h* were described as being generally parallel to the tube and the flat surface 60 of the platen 28. The pistons 14*a-h* are constantly being traversed up and down as different timing. However, each of the pistons 14*a-h* reciprocates between extended and retracted positions which traverse about a common axis. This common axis is parallel to the tube 12 and the flat surface 60 of the platen 28. The cams 18*a-h* are also parallel to the pistons 14*a-h*, tube 12 and the flat surface 60 of the platen 28. In particular, the cams 18*a-h* all have identical earning surfaces. However, these surfaces are angularly offset from each other. Nonetheless, the cams 18*a-h* share a common rotating axis 76. It is this common rotating axis 76 that is parallel to the pistons 14*a-h*, tube 12 and the flat surface 60 of the platen 28.

The above description is given by way of example, and not limitation. Given the above disclosure, one skilled in the art could devise variations that are within the scope and spirit of the invention disclosed herein, including various ways of opening the pinch valve 50 upon closure of the latch 38. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A peristaltic pump for flowing fluid through a lumen of a tube, the tube defining a diameter, the pump comprising:

a plurality of pistons linearly arranged adjacent to each other in a straight configuration, each of the plurality of pistons defining opposed first and second ends, each of the plurality of pistons traversable between extended and retracted positions;

a plurality of lifters, each lifter being pivotable about a pivot axis for traversing the piston to the extended position, each lifter having a piston contact surface and a cam engagement surface, the piston contact surface defined by a portion of the lifter where the lifter contacts the piston to traverse the piston to the extended position;

a platen disposed adjacent to the first ends of the plurality of pistons, the support surface generally parallel to the plurality of pistons wherein a gap between the first end of one of the plurality of pistons and the platen is smaller than a diameter of the tube when the piston is traversed to the extended position;

a rotatable cam shaft generally parallel to the plurality of pistons;

a plurality of cams mounted to the rotatable cam shaft, each of the cams having a cam lobe, the cam lobes of the plurality of cams engaging respective ones of the cam engagement surfaces of the lifters, the cam engagement surface defined by a portion of the lifter where the cam applies force to the lifter, the second ends of the pistons positioned half way between the cam engagement surfaces of the lifters and the pivot axes of the lifters so that as the cam shaft rotates, curved peak surfaces of the lobes raise the lifters with a mechanical advantage to traverse the pistons to the extended position, the curved peak surfaces having an a arc configuration with a center at a rotational axis of the cam, the plurality of cams are angularly displaced with respect to an adjacent cam with the curved peak surfaces of adjacent cams overlapping each other, the plurality of pistons being sequentially traversed to the extended position to flow fluid through the tube.

2. The pump of claim 1 wherein the platen is traverseable between an open position for inserting or removing the tube between the plurality of pistons and the platen and a closed position for flowing fluid through the lumen of the tube when the tube is disposed between the platen and the plurality of pistons.

3. The pump of claim 1 further comprising:

a worm gear attached to the cam shaft;

a worm drive engaged to the worm gear;

a motor attached to the worm drive for rotating the worm drive.

4. The pump of claim 1 wherein the plurality of pistons linearly occludes the tube as each one of the plurality of pistons is sequentially traversed to the extended position due to the angular displacement of the cams.

5. The pump of claim 1 wherein each of the cams has four lobes spaced 90 degrees apart from each other, and a total angular displacement of the plurality of cam is 90 degrees.

6. The pump of claim 1 wherein the pistons reciprocate between extended and retracted positions about a common axis, and the common axis of the reciprocating pistons, a flat surface of the platen and a rotating axis of the cam shaft are parallel with each other.

* * * * *